US008807380B2

(12) United States Patent
Cohen

(10) Patent No.: US 8,807,380 B2
(45) Date of Patent: Aug. 19, 2014

(54) WASTE RECEPTACLE SYSTEM FOR SECURING A PLURALITY OF PLASTIC LINERS

(75) Inventor: Benyamin Cohen, D.N. Shimshon (IL)

(73) Assignee: Avinoam Shemesh, Bet Shemesh (IL)

( * ) Notice: Subject to any disclaimer, the term of this patent is extended or adjusted under 35 U.S.C. 154(b) by 0 days.

(21) Appl. No.: 14/124,797

(22) PCT Filed: Jun. 7, 2012

(86) PCT No.: PCT/IL2012/000223

§ 371 (c)(1),
(2), (4) Date: Dec. 10, 2013

(87) PCT Pub. No.: WO2012/168937

PCT Pub. Date: Dec. 13, 2012

(65) Prior Publication Data

US 2014/0117019 A1 May 1, 2014

(30) Foreign Application Priority Data

Jun. 9, 2011 (IL) ..... 213465

(51) Int. Cl.
*B65F 1/06* (2006.01)
*B65F 1/14* (2006.01)

(52) U.S. Cl.
CPC . *B65F 1/06* (2013.01); *B65F 1/141* (2013.01); *B65F 1/062* (2013.01)
USPC ..... 220/495.07

(58) Field of Classification Search
CPC ..... B65F 1/067; B65F 1/068; B65F 1/062; B65F 1/06; B65F 1/0073; B65F 1/0053
USPC ..... 220/495.07, 495.06, 495.01, 908.1, 220/908, 630, 628
See application file for complete search history.

(56) References Cited

U.S. PATENT DOCUMENTS

2007/0235455 A1 10/2007 Goldberg

FOREIGN PATENT DOCUMENTS

WO 2009097675 A1 8/2009

OTHER PUBLICATIONS

International Search Report for a counterpart foreign application—PCT/IL2012/000223—4 pages—Sep. 12, 2012.

*Primary Examiner* — Robert J Hicks
(74) *Attorney, Agent, or Firm* — Roach Brown McCarthy & Gruber, P.C.; Kevin D. McCarthy

(57) ABSTRACT

A waste receptacle system (10) for securing a plurality of plastic liners, which comprises a waste receptacle (5), two or more plastic liners (9) in a compressed state which are extended along all of soiling susceptible surfaces of the waste receptacle (5), and a base element (15) underlying, and coupled to, at least a portion of the waste receptacle (5), for supporting the waste receptacle (5) and for applying an adjustable pressing force to the two or more liners (9). An outwardly facing liner of the two or more liners (9) is removable from the system (10) when the pressing force is reduced and is secured and irremovable from the system (10) when the pressing force is increased.

9 Claims, 4 Drawing Sheets

WASTE RECEPTACLE SYSTEM FOR SECURING A PLURALITY OF PLASTIC LINERS

FIELD OF THE INVENTION

The present invention relates to the field of waste receptacles. More particularly, the invention relates to a waste receptacle system for securing a plurality of plastic liners, into one of which waste products are depositable at any given time.

BACKGROUND OF THE INVENTION

The conventional method of lining a waste receptacle whereby the upper edge of a plastic liner is draped over the rim of the waste receptacle and the bottom attached edge is directed into the interior of the receptacle to define the liner is associated with several drawbacks. If the liner is undersized, or if relatively heavy waste products are deposited into the receptacle, the upper edge tends to be released from the rim, causing the inner surface of the receptacle to be soiled when the liner falls inwardly or when other waste products are subsequently deposited within the receptacle. If the liner is oversized, the waste receptacle suffers from a disorderly appearance.

Several prior art configurations including US 2007/235455, U.S. Pat. No. 6,808,073 and JP 03-147601 have attempted to overcome these deficiencies by providing a plurality of compressed plastic liners arranged such that when a top liner is filled, it is removed and the next liner remains neatly in place for subsequent filling.

However, the liners of these prior art configurations fail to cover the outer surface of the waste receptacle, which also tends to become soiled as a result of the dripping of liquid waste products being deposited within the receptacle. Also, the top edge of the plurality of liners is liable to become soiled by the dripped liquid waste. Thus all of the liners will remain with a malodorous odor for a long period of time until used.

It is an object of the present invention to provide a waste receptacle system for securing a plurality of plastic liners, into one of which waste products are depositable at any given time It is an additional object of the present invention to provide a waste receptacle system for securing a plurality of plastic liners arranged such that the outer surface of the waste receptacle always remains covered.

Other objects and advantages of the invention will become apparent as the description proceeds.

SUMMARY OF THE INVENTION

The present invention provides a waste receptacle system for securing a plurality of plastic liners, comprising a waste receptacle, two or more plastic liners in a compressed state which are extended along all of soiling susceptible surfaces of said waste receptacle, and a base element underlying, and coupled to, at least a portion of said waste receptacle, for supporting said waste receptacle and for applying an adjustable pressing force to said two or more liners, wherein an outwardly facing liner of said two or more liners is removable from said system when said pressing force is reduced and is secured and irremovable from said system when said pressing force is increased.

In one aspect, the waste receptacle has an H-shaped cross section to define an upper waste product insertable cavity and a lower base element receivable cavity.

In one aspect, the waste receptacle has a substantially horizontally extending support surface which separates the waste product insertable cavity from the base element receivable cavity.

In one aspect, a bolt extending downwardly from the support surface is insertable within an aperture formed within an upper wall of the base element and is coupleable with a nut which is contactable with a lower face of said base element upper wall to generate the pressing force.

In one aspect, a seam of each of the two or more liners is disposed above the support surface, all inner and outer wall surfaces of the waste product insertable cavity are covered by the two or more liners, and a terminal edge of the two or more liners bordering an opening thereof is disposed between the support surface and the base element upper wall, the pressing force being applied to said terminal edge.

In one aspect, the bolt is interposed between opposed terminal edge regions of each of the two or more liners.

In one aspect, the base element has a hollow interior for accessing the bolt and nut.

In one aspect, the system further comprises means for preventing rotation of the bolt while the nut is being coupled therewith.

In one aspect, the length of each of the two or more liners from the seam to the terminal edge ranges from 2.5 to 4 times the height a substantially vertically disposed waste receptacle wall.

DETAILED DESCRIPTION OF PREFERRED EMBODIMENTS

The present invention is a novel waste receptacle system for securing a plurality of plastic liners, into one of which waste products are depositable at any given time. A plurality of plastic liners in a compressed state are placed in engagement with the entire periphery of waste receptacle surfaces that are susceptible of becoming soiled and are secured to the waste receptacle by means of an underlying base element.

Figure 1:
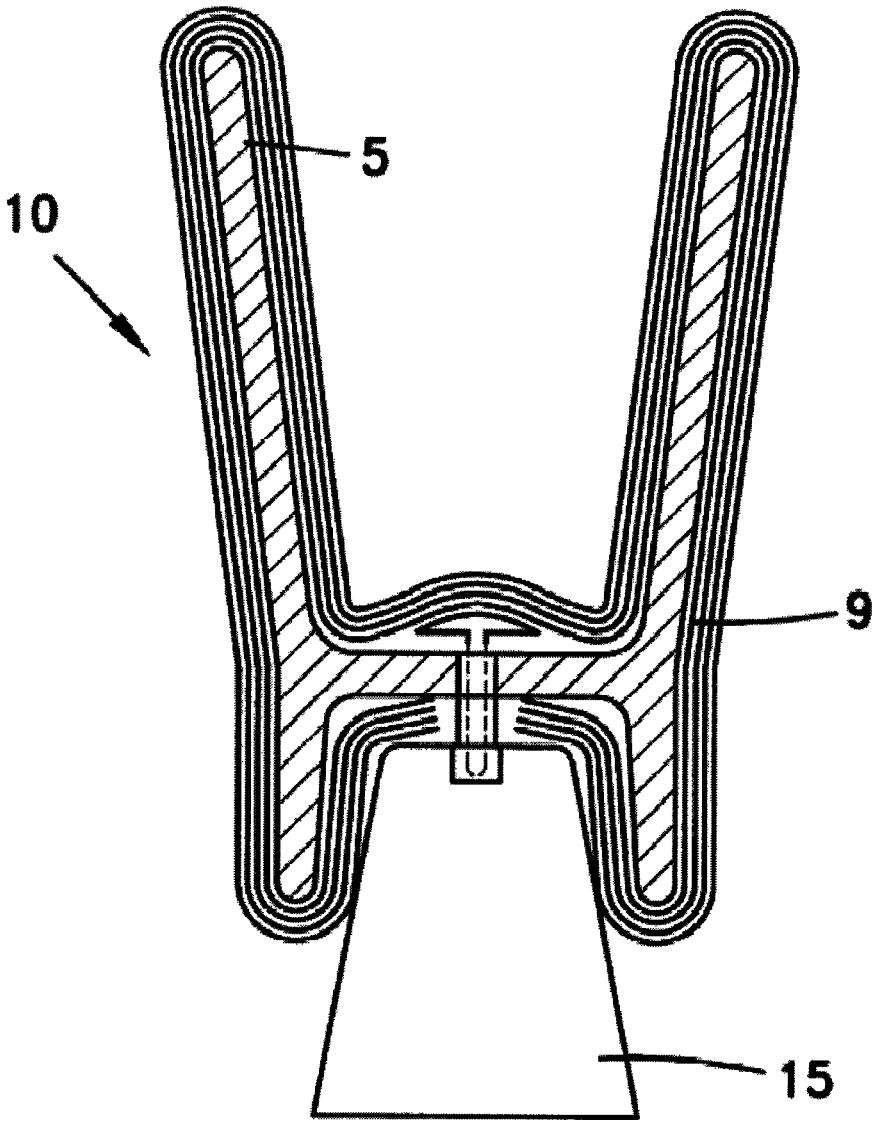
FIG. 1 is a vertical cross sectional view of a waste receptacle system, according to one embodiment of the present invention.

FIG. 1 illustrates a waste receptacle system according to one embodiment of the present invention, and is generally designated by numeral 10. Waste receptacle system 10 comprises waste receptacle 5 having an H-shaped cross section, base element 15, a bolt and nut arrangement for coupling together waste receptacle 5 and base element 15, and a stack of plastic liners 9 in a compressed state which are fixated by the pressing action effecting by the waste receptacle and base element.

Figure 2:
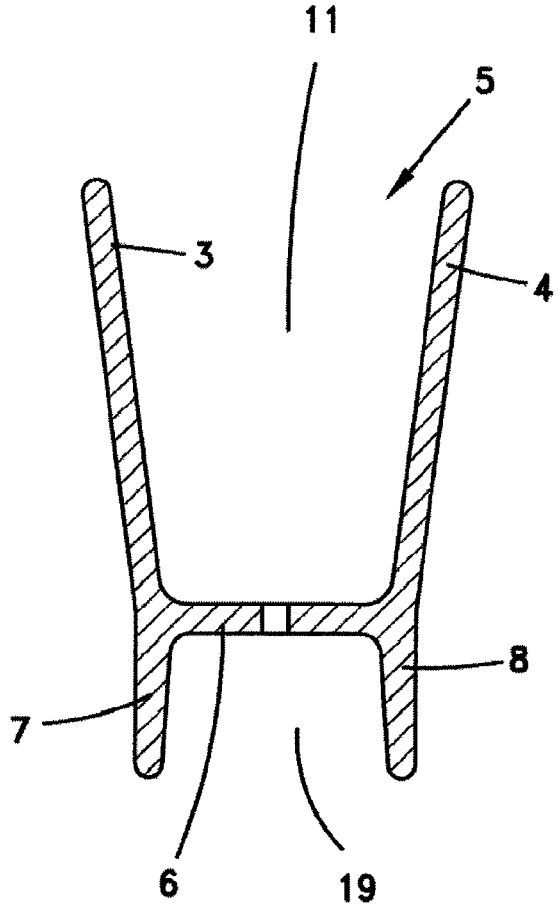
FIG. 2 is a vertical cross sectional view of a waste receptacle used in conjunction with the waste receptacle system of FIG. 1.

FIG. 2 illustrates waste receptacle 5. Waste receptacle 5 has upper spaced substantially vertically oriented walls 3 and 4, and a substantially horizontal support surface 6 extending between the bottom of walls 3 and 4, which define a cavity 11 for the insertion therewithin of waste products. Lower spaced substantially vertically oriented walls 7 and 8, which are significantly shorter than the upper walls, e.g. approximately one-third the length, extend downwardly from support surface 6 to define a lower cavity 19 adapted to receive the base element. An aperture 2 is formed within support surface 6 for the introduction therein of the bolt.

Walls 3, 4, 7 and 8 may all be planar walls, e.g. integrally formed walls, to define rectangular cavities 11 and 19. Waste receptacle 5 may accordingly be configured such that walls and 7 are collinear and walls 4 and 8 are collinear.

Alternatively, waste receptacle 5 may comprise a single outer rounded wall which is divided by support surface 6 into cavities 11 and 19. The outer wall may gradually taper downwardly such that the width of lower cavity 19 is less than the width of upper cavity 11.

Each of the plastic liners used in the present invention is significantly longer than a liner used to be draped over the rim of a prior art waste receptacle. The length of a plastic liner used in conjunction with a prior art waste receptacle, as measured from the seam usually placed on or near the bottom support surface of the waste product insertable cavity to the terminal edge of the liner bordering its opening, is only slightly longer, and usually no more than L5 times the height of the waste receptacle walls. The length of the liner used in the present invention, in contrast, has a length of approximately 3 times, or ranging from 2.5-4 times, the height of the waste receptacle walls.

A liner of such a relatively long length can therefore extend along all of the soiling susceptible surfaces of waste receptacle 5, i.e. the inner and outer faces of each of walls 3, 4, 7 and 8 and the upper face of support surface 6 while passing over the bolt, to prevent these surfaces from becoming soiled.

Figure 4:
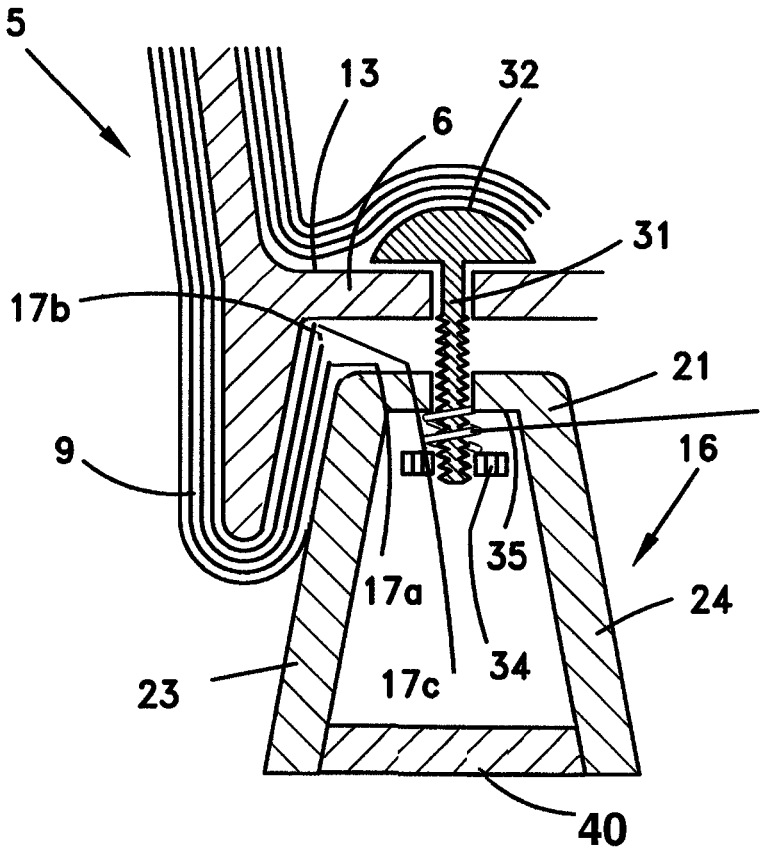
FIG. 4 is a partial, enlarged vertical cross sectional view of a waste receptacle system, showing another embodiment of a base element and a stack of liners being secured thereby.

Referring to FIG. 4, a stack of liners 9 can therefore be applied to waste receptacle 5, ensuring that an outwardly facing liner that becomes filled or soiled can be easily removed and disposed of, and that a subsequently exposed adjacent liner will be clean and not malodorous. Since the outwardly facing liner as well as all adjacent liners are extended along all of the soiling susceptible surfaces of waste receptacle 5, terminal edge 17*a* of the outwardly facing liner is laterally spaced from terminal edges 17*b* and 17*c* of adjacent liners due to the thickness of the stack of layers 9 and the corresponding increased peripheral length of the adjacent layers. Base element 15 may also include a horizontal flat bench 40, for allowing the user to attach the waste receptacle 10 to the floor, while pulling a plastic liner from the stack. Flat bench 40 may comprise through-holes (not shown) to receive bolts that may be used to permanently attach the receptacle to the floor, if so desired.

Figure 3:
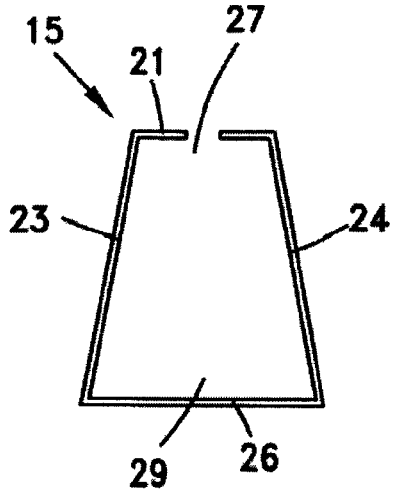
FIG. 3 is a vertical cross sectional view of a base element used in conjunction with the waste receptacle system of FIG. 1.

Base element 15 shown in FIG. 3 has a suitable configuration that allows placement of an upper portion thereof within cavity 19, in relatively close proximity to the inner face of walls 7 and 8 and to the bottom face of support surface 6, to facilitate securing the plurality of liners 9. Base element 15 may have a planar upper surface 21 placeable in close proximity to support surface 6 of waste receptacle 5, sloped side walls 23 and 24 adjacent to walls 7 and 8, respectively, and a bottom surface 26 extending between side walls 23 and 24. An aperture 27 is formed in upper surface 21 thereof, and is alignable with aperture 2 formed within support surface 6 of waste receptacle 5 (FIG. 2). Base element 15 may have a hollow interior 29 to enable manipulation of the bolt and nut arrangement by which the waste receptacle and base element are coupled together.

It will be appreciated that base element 15 may also be predominantly solid and formed with a cavity through which the bolt and nut arrangement may be accessed.

A base element 16 is shown in FIG. 4. Base element 16 is configured similarly to base element 15 of FIG. 3, but without the bottom surface, while side walls 23 and 24 stably support the waste receptacle system. A bolt 31 is introduced through the aligned apertures 2 (FIG. 2) of the waste receptacle and 27 (FIG. 3) of the base element, and is coupled to nut 34. After a stack of liners 9 in a compressed state are extended along all of the soiling susceptible surfaces of waste receptacle 5, nut 34 is tightened until it bears on the lower face 35 of base element upper surface 21. Thus the stack of liners 9 are pressed simultaneously and thereby secured by head 32 of bolt 31, which bears downwardly on upper face 13 of support surface 6, and nut 34 which bears upwardly on the lower face 35 of base element upper surface 21. In order to maintain the stack of liners 9 pressed even when many liners are removed from the stack, it is possible to add a spring 36, which is threaded over bolt 31 and is sandwiched between nut 34 and the planar upper surface 21. When nut 34 is sufficiently tightened, spring 36 is pressed and continuously applies pressure on upper surface 21 to be pressed against support surface 6. This pressure is applied on the remaining portion of the stack of liners 9.

When it is desired to remove the outwardly facing liner, nut 34 is simply loosened temporarily and is then retightened after the outwardly facing liner is removed, so that a subsequently exposed adjacent liner will be outwardly facing.

Figure 5:
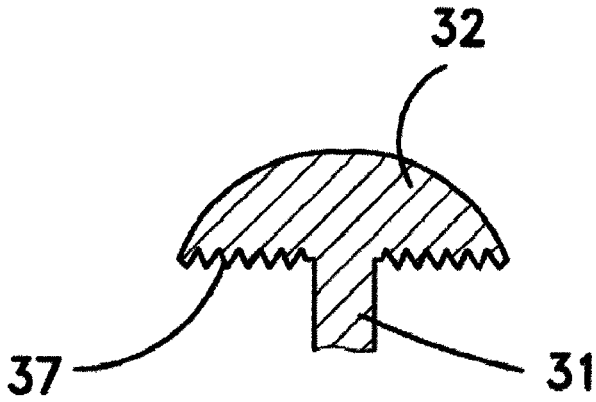
FIG. 5 is cross sectional view of a bolt used in conjunction with the waste receptacle system of FIG. 4.

As shown in FIG. 5, an underside of head 32 of bolt 31 may be formed with a plurality of protruding elements 37 for frictionally engaging upper face 13 of support surface 6 (FIG. 4) to provide a reactive force while nut 34 is being tightened or loosed with respect to bolt 31.

Figure 6:
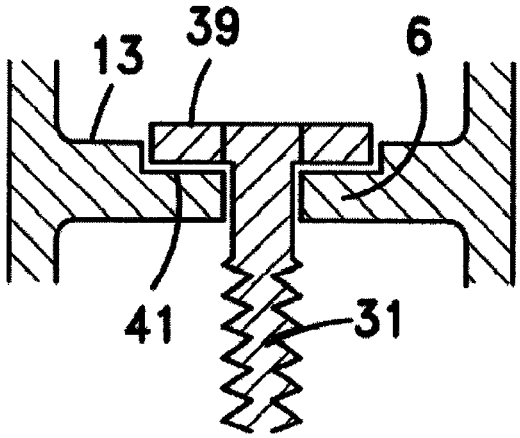
FIG. 6 is a partial, enlarged vertical cross sectional view of a waste receptacle, showing another means for preventing rotation of a bolt for coupling the waste receptacle and base element.

Alternatively, as shown in FIG. 6, engaging upper face 13 of support surface 6 may be formed with a recessed cavity 41, in which head 39 of bolt 31 is seated and prevented from being rotated, for example both the recess and bolt head are polygonal with an identical number of sides.

If so desired, the bolt may be integrally formed with the waste receptacle.

According to another embodiment, the wall thickness of waste receptacle 5 may be limited to 1 mm and made from a reinforced plastic or other acrylic material, so as to save raw material and reduce costs. This feature is made feasible since the base element 15 carries most of the weight. Therefore, the side walls of waste receptacle 5 should be sufficiently enforced only to resist widthwise forces.

It is also possible to add a fragrant material to each liner in the form of uniform plating, in order to add flavored fragrance. Alternatively, the plating may have a form such as a logo, a symbol etc. For example, a lemon may represent lemon-like fragrant.

According to another embodiment, the bolt and nut arrangement may be replaced by an engagement mechanism, for coupling together waste receptacle 5 and base element 15, and a stack of plastic liners 9 in a compressed state. Such engagement mechanism may be, for example, a semi-elastic bulb (not shown) that extends from waste receptacle 5 and inserted into a mating cavity in base element 15 via a narrow inlet. When the user presses the bulb into the inlet, the bulb is mashed from its side and returns to its original shape when passing from the inlet into the cavity.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A waste receptacle system for securing a plurality of plastic liners, comprising a waste receptacle, two or more plastic liners in a compressed state which are extended along all of soiling susceptible surfaces of said waste receptacle, and a base element underlying, and coupled to, at least a portion of said waste receptacle, for supporting said waste receptacle and for applying an adjustable pressing force to said two or more liners, wherein an outwardly facing liner of said two or more liners is removable from said system when said pressing force is reduced and is secured and irremovable from said system when said pressing force is increased.

2. The waste receptacle system according to claim 1, wherein the waste receptacle has an H-shaped cross section to define an upper waste product insertable cavity and a lower base element receivable cavity.

3. The waste receptacle system according to claim 2, wherein the waste receptacle has a substantially horizontally extending support surface which separates the waste product insertable cavity from the base element receivable cavity.

4. The waste receptacle system according to claim 3, wherein a bolt extending downwardly from the support surface is insertable within an aperture formed within an upper wall of the base element and is coupleable with a nut which is contactable with a lower face of said base element upper wall to generate the pressing force.

5. The waste receptacle system according to claim 4, wherein a seam of each of the two or more liners is disposed above the support surface, all inner and outer wall surfaces of the waste product insertable cavity are covered by the two or more liners, and a terminal edge of the two or more liners bordering an opening thereof is disposed between the support surface and the base element upper wall, the pressing force being applied to said terminal edge.

6. The waste receptacle system according to claim 5, wherein the bolt is interposed between opposed terminal edge regions of each of the two or more liners.

7. The waste receptacle system according to claim 4, wherein the base element has a hollow interior for accessing the bolt and nut.

8. The waste receptacle system according to claim 4, further comprising means for preventing rotation of the bolt while the nut is being coupled therewith.

9. The waste receptacle system according to claim 5, wherein the length of each of the two or more liners from the seam to the terminal edge ranges from 2.5 to 4 times the height a substantially vertically disposed waste receptacle wall.

* * * * *